United States Patent [19]

Courchaine et al.

[11] Patent Number: 4,596,275

[45] Date of Patent: Jun. 24, 1986

[54] REINFORCED HEDDLE FRAME SLAT AND METHOD

[75] Inventors: Wilfred J. Courchaine, Lyman; George W. Riebe, Greenville, both of S.C.

[73] Assignee: Steel Heddle Manufacturing Company, Greenville, S.C.

[21] Appl. No.: 660,529

[22] Filed: Oct. 12, 1984

[51] Int. Cl.[4] ..... D03C 9/06

[52] U.S. Cl. ..... 139/91

[58] Field of Search ..... 139/91, 92, 82, 83, 139/88

[56] References Cited

U.S. PATENT DOCUMENTS

| | | | |
|---|---|---|---|
| 3,074,438 | 1/1963 | Svaty | 139/91 |
| 3,155,118 | 11/1964 | Kaufmann | 139/91 |
| 3,696,842 | 10/1972 | Pfarrwaller | 139/91 |
| 3,889,721 | 6/1975 | Wagner | 139/91 |
| 4,112,980 | 9/1978 | Bader | 139/92 |
| 4,227,553 | 10/1980 | Schwarz | 139/91 |
| 4,254,802 | 3/1981 | Kaufmann et al. | 139/91 |

FOREIGN PATENT DOCUMENTS

| | | | |
|---|---|---|---|
| 2545965 | 1/1977 | Fed. Rep. of Germany | 139/88 |
| 451040 | 5/1968 | Switzerland | 139/91 |

*Primary Examiner*—Henry S. Jaudon

*Attorney, Agent, or Firm*—Dority & Manning

[57] ABSTRACT

A reinforced heddle frame slat and method are disclosed which includes a hollow frame slat in which a narrow slit (42) is first made in a bottom wall (38) of the frame slat. A pair of halves of material (44, 46) formed on each side of the slit are then folded back by a punch. The folded halves provide a double thick reinforcing wall around a periphery of a drive slot opening (A) which make the drive slot reinforced and safer to handle. The drive slot opening is dimensioned to receive a drive member (28) which makes a drive connection with a pushrod block (26).

13 Claims, 8 Drawing Figures

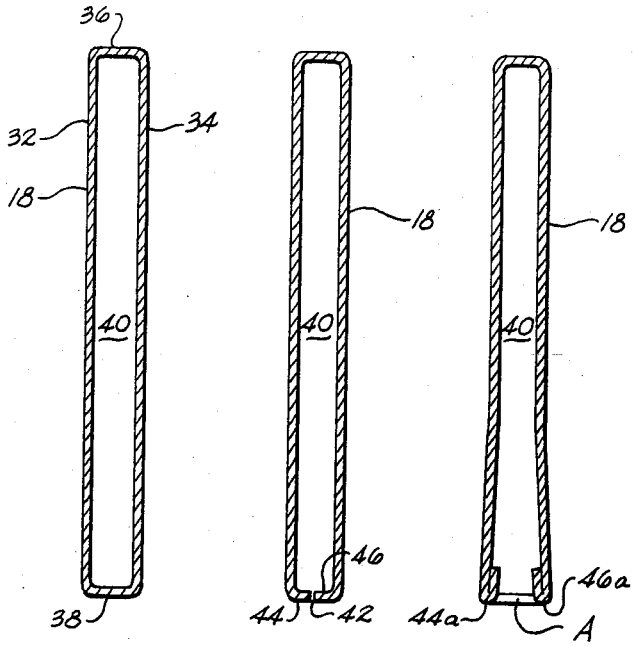
Fig.3a Fig.3b Fig.3c
Fig.4a
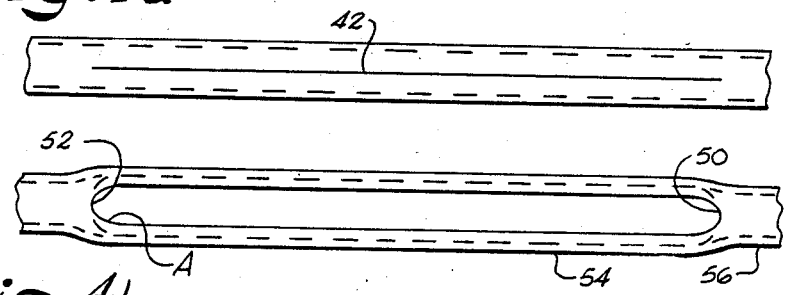
Fig.4b
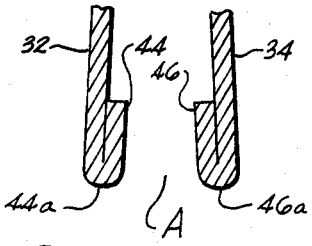
Fig.5

REINFORCED HEDDLE FRAME SLAT AND METHOD

BACKGROUND OF THE INVENTION

The invention relates to a construction and method for a frame slat of a heddle frame for a loom wherein a drive slot opening which receives a drive hook that reciprocates the heddle frame is reinforced.

The typical heddle frame includes a top frame slat and a bottom frame slat between which a number of heddles are carried in the frame. The bottom frame slat includes a connector block which is engaged by a drive hook of a drive mechanism to reciprocate the heddle frame in vertical motions during weaving. The connector block is carried in a hollow portion of the frame slat in the case of a tubular frame slat. For access to the connector, material has to be removed and a slot formed in a bottom wall of the bottom frame slat. This cutting and removal of material is in a critical area of the frame slat which is highly suceptible to fatigue by reason of the drive connection with the drive mechanism for the heddle frame. The removal of material weakens an already vulnerable area of the frame slat and numerous attempts have been made to reinforce this section of the bottom frame slat against structural fatigue and failure such as cracking.

In U.S. Pat. No. 4,254,802, a frame slat and method is disclosed wherein reinforcing plates are spot-welded to the frame slat in the area of the drive slot which is formed to receive the drive connector of the heddle frame drive mechanism. While this method is effective for reinforcing the drive slot area, it necessarily involves additional process steps in the constructing of the heddle frame which is both time and labor consuming. Additional weight is also added to the frame slat by this method.

With the increasing use of high speed looms in which the heddle frame is reciprocated in vertical motions at even faster rates, the weight and hence inertia of the heedle frame becomes critical.

Accordingly, an important object of the present invention is to provide a construction and method for a heddle frame wherein the drive slot formed in the bottom frame slat is reinforced in a simple and inexpensive manner without significantly increasing the weight of the frame slat.

Still another important object of the present invention is to provide a reinforced heddle frame slat and method which is reinforced without the need of additional reinforcing materials nor significant additional labor expense.

SUMMARY OF THE INVENTION

The above objectives are accomplished according to the present invention by providing in a frame slat that is hollow, a drive slot opening formed in the frame slat which includes double thick walls for reinforcing the drive slot. In the method according to the present invention, the bottom wall of the frame slat is cut and the material is rolled back to form an uncut exposed edge around the periphery of the drive slot with double walls around the sides of the rod slot. By slitting the hollow frame slat along the bottom wall and punching the material inwardly of the hollow frame slat without removing the material, double walls are formed around the sides of the drive slot which reinforce the drive slot.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 3*a* is a section through a drive frame slat prior to having a reinforced drive slot formed in accordance with the present invention;

FIG. 3*b* is a sectional view of a drive frame slat having a narrow slit formed along its bottom wall as a first step for providing reinforcement to the drive slot area of the frame slat;

FIG. 3*c* is a sectional view of a drive frame slat according to the invention wherein the free halves of the material cut in the area of the drive slot are deformed and folded into the hollow interior of the frame slat to reinforce the frame slat;

FIG. 4*a* is a bottom plan view of a bottom wall of a drive frame slat in which a narrow slit is formed prepatatory to reinforcing the drive slot opening according to the present invention;

FIG. 4*b* is a plan view of the bottom wall of a drive frame slat according to the present invention wherein the cut halves of the frame slat wall are folded back inwardly into the interior of the hollow frame slat to reinforce the drive slot opening; and FIG. 5 is an enlarged cross-sectional view of a reinforced drive slot opening according to the present invention.

DESCRIPTION OF A PREFERRED EMBODIMENT

The invention relates to an improved frame slat construction for a heddle frame wherein the frame slat in the area of a drive slot opening is reinforced and made safer to handle.

Figure 1:
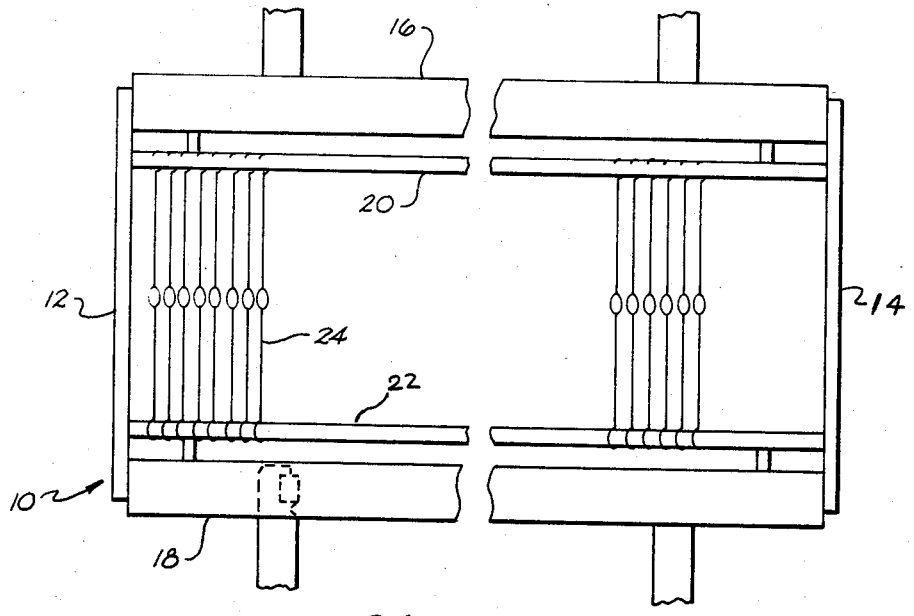
FIG. 1 is a front elevation of a heddle frame having reinforced drive frame slat according to the present invention.
Figure 2:
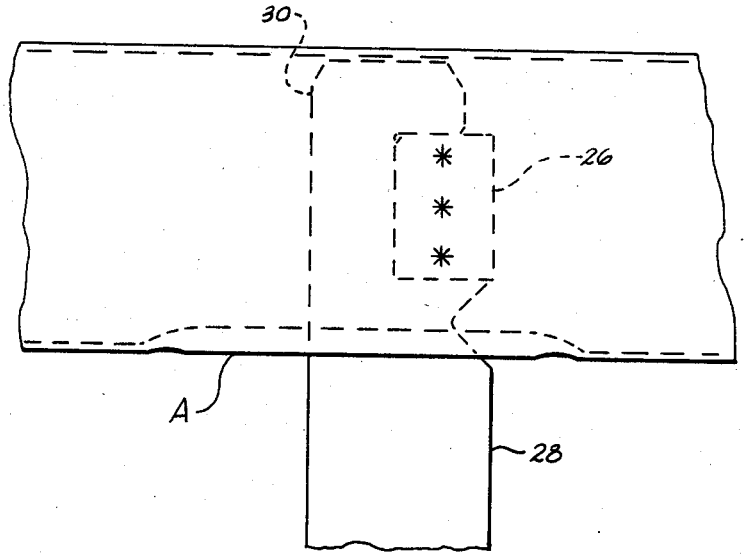
FIG. 2 is an elevation of a reinforced drive frame slat and method according to the present invention.

Referring now in more detail to the drawings, FIG. 1 illustrates a heddle frame designated generally as 10 which includes a pair of side frame members 12 and 14. A top frame slat 16 is carried at the top of the heddle frame and a bottom frame slat 18 is carried at the bottom of the frame. There are heddle support rods 20 and 22 carried by the frame slats on which a plurality of heddles 24 are carried in the frame. The bottom frame slat 18 includes means for making drive connection with a drive mechanism of the loom which reciprocates the heddle frame in vertical motions. For this purpose, there is a connector pushrod block fixed to the bottom frame slat 18 within the hollow interior of the frame slat. There is a drive slot opening A in which a drive member 28 is received which includes a hook end 30 which hooks the pushrod block 26 and makes a drive connection.

Referring now in more detail to FIGS. 3*a*–3*c*, there is shown a cross-section of a tubular frame slat 18 which is constructed in accordance with the present invention and method. The frame slat includes vertical side walls 32 and 34. There is a top wall 36 bridging the side walls 32 and 34 and a bottom wall 38 through which the drive slot opening A is formed. The walls of the frame slat thus provide a tubular frame slat having a hollow interior 40.

In accordance with the method of the present invention, the drive slot opening A is formed by forming a narrow slit 42 longitudinally along the middle of the bottom wall 38 corresponding generally in length to the rod slot opening. The longitudinal slit 42 thus defines a first bottom half 44 of material and a second bottom half 46 of material on the sides of the longitudinal slit. Next, the halves 44 and 46 are folded inwardly to lie generally flush against the interior sides of the side walls 32 and 34. A rounded edge 44*a* and 46*a* is formed by the folded halves. The rounded edge makes the slot opening safer to handle as compared to the previously punched out rod slot openings which leave sharp and burred edges at times.

In the method, the halves of material 44 and 46 are folded back by inserting a punch against and through the slit 42 while the sides 32 and 34 of the frame slat are held by pressure plates. The punch tool is formed such that rounded ends 50 and 52 are formed at the ends of the rod slot opening so that corner notches are eliminated. The corner notches as would be formed from a square or rectangular end would form corner notches which could crack under stress and form fatigue spots. The curved ends as shown at 50 and 52 are advantageously formed to avoid these corner notches and reduce fatigue failure at these critical points at the end of the slot as can best be seen in FIG. 4*b*. Next, a punch tool is inserted in the slot opening A and the sides of the frame slat are forced inwardly on the tool so that the double walls such as 44 and 32 are compacted together. It will be noted however that the section of the rod slot opening is widened at 54 relative to the frame slat thickness at 56. This enables the width of the rod slot opening to be essentially of the same width as a standard rod slot opening cut in a conventional frame slat. This enables the connector block 26 to be inserted through the opening to be affixed in the frame slat by spot welding. This also enables a standard connector 28 of standard thickness to be received in the slot opening.

According to the present invention, the side walls 32 and 34 are caused to terminate in rounded edges 44*a* and 46*a*. There are upturned truncated side walls formed by rhe halves 44 and 46 folded inwardly and generally vertically lying flush against the major side walls 32 and 34. In the frame slat product of the present invention, the interior truncated side walls provided by the upturned halves 44 and 46 provide a double wall construction around generally the entire periphery of the rod slot opening. This stiffens the rod slot opening and reinforces it against the forces encountered during shedding or reciprocation of the heddle frame during weaving. The drive member 28 hooked onto the pushrod block 26 produces considerable dynamic vibrational forces and engaging sides of the rod slot opening during conventional operation. This double wall thickness provides a heddle frame which has been found to provide at least four times greater resistance to fatigue failures than conventional rod slots. The rounded edges 44*a* and 46*a* formed by the folded halves provide a smooth edge around the rod slot opening which makes it safer to handle.

It will be understood, of course, that while the form of the invention herein shown and described constitutes a preferred embodiment of the invention, it is not intended to illustrate all possible form of the invention. It will also be understood that the words used are words of description rather than of limitation and that various changes may be made without departing from the spirit and scope of the invention herein disclosed.

What is claimed is:

1. A method of reinforcing a drive slot opening on a handle frame for use on a loom, said heddle frame being of the type having a frame slat carried across a bottom of the frame having at least one drive slot opening for receiving a drive member of a drive mechanism of the loom which reciprocates the heddle frame in up-and-down vertical motions, said method comprising the steps of:

providing an elongated tubular frame slat;

forming a longitudinal slit in a bottom wall of said frame slat to define a first bottom half and a second bottom half on either side of said longitudinal slit; and folding said first and second bottom halves generally ninety degrees to lie approximately flush with the interior of said side walls within the interior of said tubular frame slat so that said folded halves provide additional material for stiffening and reinforcing said drive slot opening;

whereby said frame slat is reinforced and safer to handle in the area of said rod slot opening.

2. The method of claim 1 further including the step of providing a pushrod block fixed between said sidewalls of said tubular frame slat within the hollow interior of said frame slat.

3. The method of claim 1 wherein said folding step includes the step of bringing a punching tool into engagement with said bottom halves formed on either side of said slit.

4. The method of claim 3 wherein said folding step further includes the step of holding the side walls so said frame slat with pressure plates as said punching tool is brought into engagement with said bottom halves.

5. The method of claim 1 wherein said folding step includes the step of forming a curved end portion on each end of said drive slot opening generally adjacent ends of said longitudinal slit.

6. A method of reinforcing a drive rod slot opening of a frame slat of a heddle frame of a loom comprising:

folding back material from a bottom wall of said frame slat to provide a rolled edge generally along the sides of said drive rod slot opening and a double wall thickness around said sides of said drive rod slot opening so that said drive rod slot opening is reinforced having smoother edges for safer handling.

7. The method of claim 6 wherein said rolled edge and double wall thickness of said sides are provided by forming a longitudinal slit in a bottom wall of said frame slat to define first and second halves of material on either side of said longitudinal slit, and subsequently folding back said first and second halves so as to lay generally flush against the interior side of said vertical sides and thereby form said double wall thicknesses around the periphery of said drive rod slot opening.

8. The method of claim 7 wherein said first and second halves of material are folded back by bringing a punching tool into engagement with said bottom wall of said frame slat.

9. The method of claim 6 including forming rounded ends at the ends of said drive rod slot opening to eliminate corner notches.

10. A reinforced frame slat for a heddle frame of a loom, comprising:

a pair of spaced side walls, each terminating with a rounded edge;

a top wall bridging said side walls;

a bottom wall bridging said side walls comprising a tubular configuration having an open interior and defining at least one, drive rod slot opening formed in said bottom wall; and a pair of upturned interior side walls extending towards said top wall respectively from each of said rounded edges and terminating short of said top wall, wherein said pair of spaced side walls and pair of upturned interior side walls form a double wall side construction on either side of said rod slot opening, and said rounded edges are formed generally around the sides of said drive rod slot opening so that a reinforced drive rod slot opening is provided which has a smoother edge and is safer to handle.

11. The apparatus of claim 10, further including a connector pushrod block carried between said side walls of said frame slat and accessible through said drive rod slot opening for engagement by a drive mechanism of said loom.

12. The apparatus of claim 10 wherein the portion of said side walls of said frame slat adjacent said drive rod slot opening are further separated from each other than the remaining portion of said side walls of said frame slat.

13. The apparatus of claim 10 wherein said pair of spaced side walls, rounded edges, and upturned side walls are integrally formed.

* * * * *